United States Patent [19]

Van Bentem

[11] Patent Number: 4,878,864

[45] Date of Patent: Nov. 7, 1989

[54] OUTBOARD THRUSTER WITH DIRECT DRIVE HYDRAULIC MOTOR

[76] Inventor: Fransiscus C. A. Van Bentem, 3010 Apple Valley Ln., Missouri City, Tex. 77459

[21] Appl. No.: 169,103

[22] Filed: Mar. 9, 1988

Related U.S. Application Data

[63] Continuation of Ser. No. 879,972, Jun. 30, 1986, abandoned.

[51] Int. Cl.[4] ..... B63H 21/165

[52] U.S. Cl. ..... 440/5; 440/61

[58] Field of Search ..... 440/5, 54, 61; 114/150

[56] References Cited

U.S. PATENT DOCUMENTS

| | | | |
|---|---|---|---|
| 3,139,062 | 6/1964 | Keefe | 440/5 |
| 3,915,111 | 10/1975 | Buddrus | 440/5 |
| 4,143,614 | 3/1979 | Jeanson et al. | 440/61 |
| 4,358,280 | 11/1982 | Jeanson et al. | 440/5 X |

FOREIGN PATENT DOCUMENTS

| | | | |
|---|---|---|---|
| 1403979 | 8/1975 | United Kingdom | 440/61 |

*Primary Examiner*—Sherman D. Basinger

*Attorney, Agent, or Firm*—Dodge, Bush & Moseley

[57] ABSTRACT

In accordance with an illustrative embodiment of the present invention, a new and improved compass-type, retractable marine thruster apparatus comprises a housing pivotally mounted on a base that can be attached to the stern of a vessel, a tubular member having an upper section extending into the housing, a hub attached to the lower end of the tubular member, a cross-vane hydraulic motor in the hub and having a propeller mounted directly on its output shaft, a swivel assembly at the top of the tubular member arranged so that oil under pressure can be fed to a plurality of lines that are connected to the motor, a steering motor for rotating the tubular member about its longitudinal axis, and an hydraulic cylinder that can be extended to pivot the tubular member, hub and propeller out of the water.

8 Claims, 4 Drawing Sheets

FIG. 6
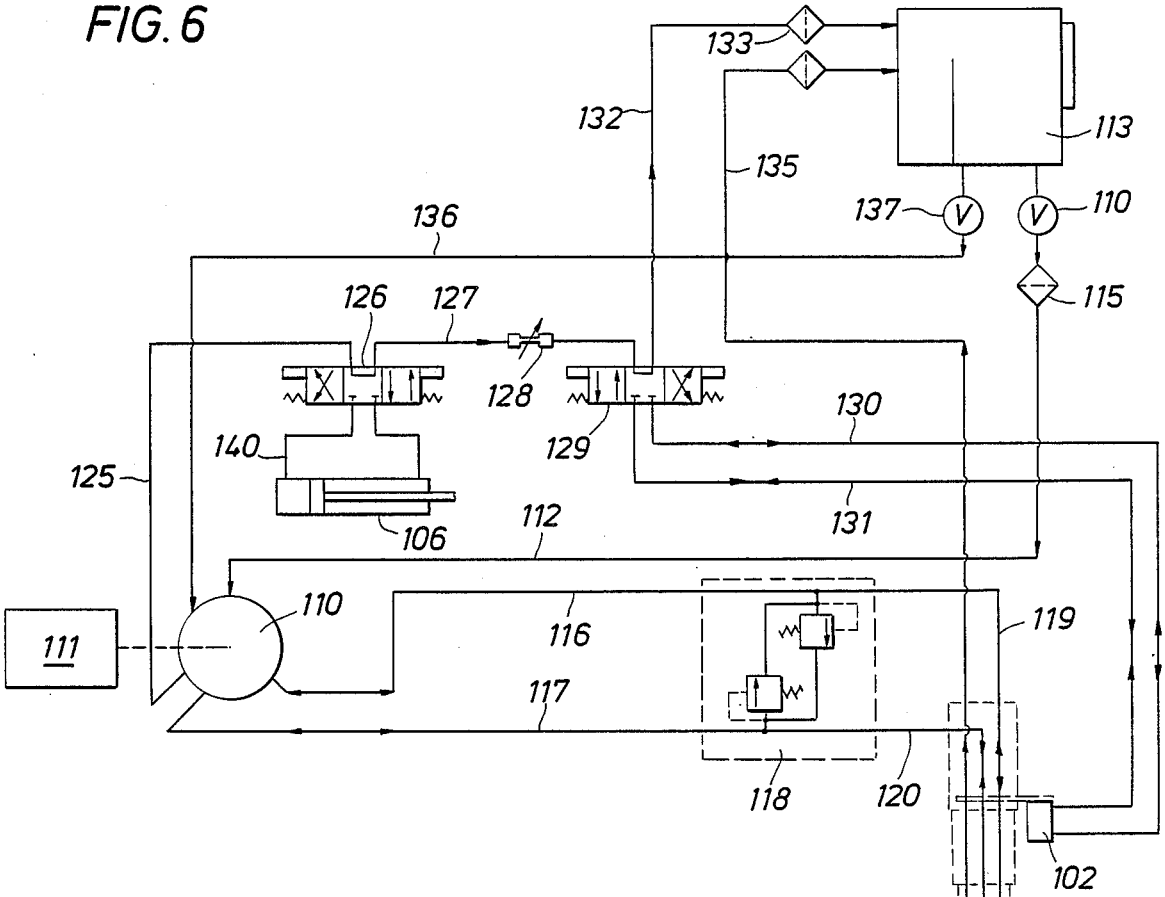
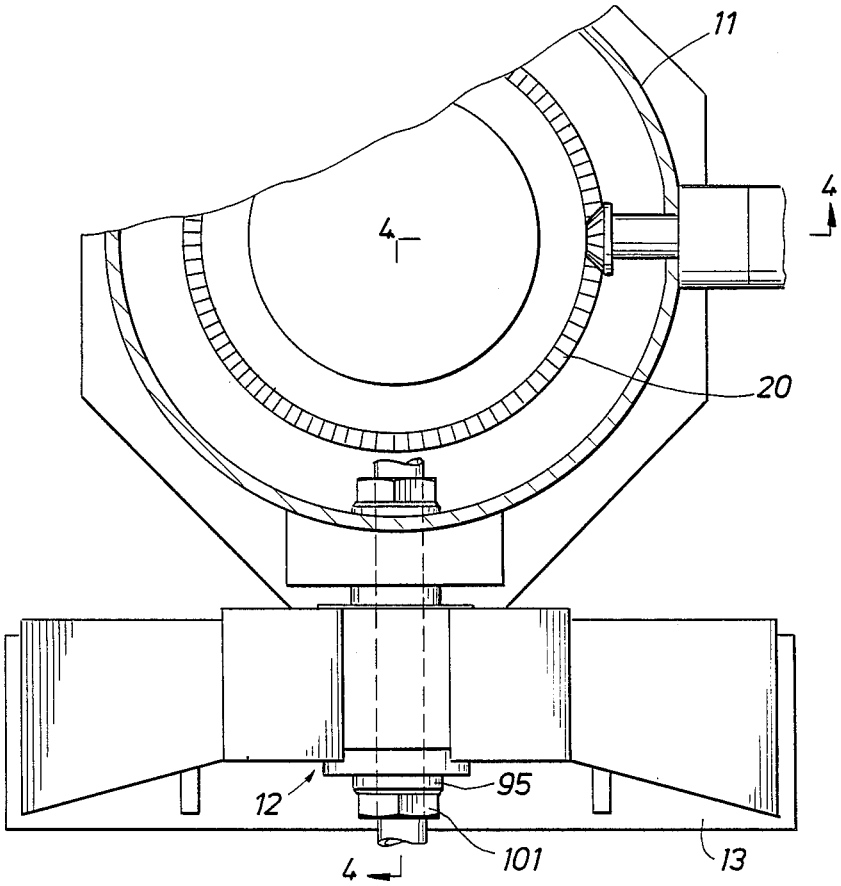
FIG. 3

OUTBOARD THRUSTER WITH DIRECT DRIVE HYDRAULIC MOTOR

This application is a continuation, division, of application Ser. No. 879,972, filed 6/30/86, and now abandoned.

FIELD OF THE INVENTION

This invention relates generally to propulsion units for marine vessels, and particularly to a new and improved compass-type outboard thruster that utilizes a hydraulic motor for direct drive of the propeller.

BACKGROUND OF THE INVENTION

The typical outboard propulsion unit used in industrial applications is a self-contained, deck-mounted device where power from a diesel engine is transmitted to the propeller through a system of drive shafts and right angle gears. Such units traditionally are offered in the 50–1000 horsepower range, and often are used for the propulsion of barges, small ships, and the like.

In the conventional prior device, the diesel engine flywheel is coupled to the outboard drive unit through a clutch, a reversing gear box, and an intermediate transmission that is designed to allow the outboard leg to be cocked or titled upward while maintaining power transmission to the propeller. This allows operation in shallow water conditions, and also allows the outboard unit to be elevated to the horizontal position for inspection and maintenance. The lower portion of the outboard drive assembly can be rotated through 360° to allow full steering and maneuvering. The horizontal drive shaft at the top of the outboard drive assembly transmits power to the vertical drive shaft assembly through a 90° spiral bevel gear. The vertical drive shaft assembly ma include several coupled sections. At the lower end of the vertical shaft assembly, power is transmitted to the propeller by another 90° angle gear arrangement. The propeller shaft is provided with seals that are supposed to prevent water from entering the outboard drive assembly.

Steering typically is accomplished through use of a 90° bevel gear, or a worm gear, that is used to rotate the lower section of the outboard drive assembly, which is supported by a suitable bearing. The steering drive shaft is powered, in the conventional example, by a bi-directional, low speed hydraulic motor mounted to the side of the vertical unit assembly and powered by a hydraulic pump that is driven from an auxiliary power take-off of the diesel engine. Cock-up, or tilting, has been accomplished by use of a hydraulic cylinder that is fed with pressurized oil from the same pump that is used for steering.

Although the above-described mechanical drive system has been widely used, it has a number of disadvantages and shortcomings in the areas of operation, reliability, longevity and maintenance requirements. Speed control of a mechanically drive, right angle geared drive shaft system is limited, because the engine can not be used effectively below its idling speed. Reversal of thrust can be accomplished only with a reversing gear, with lower response time due to higher moments of inertia, which is an extreme disadvantage in being able to cope with emergency situations. Since an auxiliary pump driven from an auxiliary power take-off on the engine is used for both steering and tilt-up, when the unit is operated at one-half speed, the auxiliary pump also runs at one-half speed. Therefore, the steering response is only one-half as fast as when the unit is operating at rated speed. By nature of its design, a mechanically drive unit is somewhat noisy in operation, especially during maneuvering when accelerations and decelerations cause back-lash in the reversing gear and the right angle drive gear transmissions. The various drive shafts vibrate in radial, axial and resultant directions, which promotes wear, as well as bearing and seal failures.

Still another disadvantage of a mechanically driven unit is that propeller speed control is accomplished by throttling the engine. Consequently, speed control during normal maneuvering involves numerous decelerations and accelerations of the engine. However, a diesel engine performs more reliably and efficiently, and has a longer service life, when operated at a constant speed at all times, which is not possible with mechanical drives. With respect to the steering gear arrangement typically used in mechanical drive systems, the engine torque is transmitted by a vertical drive shaft from the stationary to the steerable portion of the outboard drive assembly. Therefore, the steering gear must counteract the full propulsion torque to prevent the lower drive assembly from spinning around. Thus the steering gear is subjected to substantial stress loading during maneuvering and reversing, which can cause brinelling and early wear of gear and bearings.

In spite of best efforts to seal the propeller drive shaft against the entry of sea water, there appears to be no reliable way that moisture and silt can be kept out of the vertical drive assembly. Entry of moisture and silt will cause a corrosive and somewhat abrasive environment inside the unit, which, in mechanical systems, typically includes numerous machined and uncoated surfaces that are exposed. Components such as intermediate drive shafts, the gears and the bearings, normally are not made of corrosion resistant materials, so that they soon begin to corrode. This has the effect of shortening the service life of mechanically driven systems, and substantially increasing maintenance requirements.

Yet another shortcoming of mechanical drives of the type described arises in connection with accidental grounding of the lower unit. When this occurs, as it inevitably will, the vertical drive unit is subjected to bending moments far in excess of those that occur during normal operating conditions. This can result in temporary, and sometimes permanent, bending of components, which causes misalignment, seizure and occasional permanent damage to shafts, gears, or bearings. It also will be recognized that when a propeller impacts a solid object, the diesel engine drive can not stop instantaneously due to its large moment of inertia. In attempts to solve this problem, mechanical drive systems have included either a slip clutch near the engine, or a shear pin at the propeller. Slip clutches are not ideal, due to inability to accurately set break-away torque, so that propeller and shaft deceleration and clutch break-away can easily exceed stress levels where permanent damage to the propeller and/or transmission components will occur. Shear pins provide generally reliable protection, however the drive unit must be brought in for pin replacement and inspection prior to reuse.

The general object of the present invention is to provide a new and improved compass-type retractable outboard drive unit that obviates all or substantially all of the foregoing disadvantages of prior systems.

Another object of the present invention is to provide a new and improved thruster unit that includes a direct hydraulic drive to the propeller to increase overall unit reliability and longevity, with substantially reduced maintenance requirements.

SUMMARY OF THE INVENTION

These and other objects are attained in accordance with the present invention through the provision of a compass-type outboard retractable thruster apparatus including a housing pivotally mounted on a base or skid that can be attached to a vessel such as a barge or the like. A bearing head is connected to the lower end of the housing, and an elongated, generally tubular member extends into and through the head so as to be rotatable with respect to the head and the housing. A propeller hub that is fixed to the lower end of the tubular member houses a hydraulic drive motor having the propeller mounted directly to its output shaft. Flexible hydraulic lines extend from the drive motor up through the tubular member and into the housing to convey hydraulic oil under pressure to and from the motor in order to operate the same.

The hydraulic motor preferably is a cross vane, fixed displacement device through which oil is circulated via the high pressure, flexible hoses. A hydraulic swivel manifold in the housing permits rotation of the tubular member through a full 360°, whereby steering can be accomplished by a steering motor having a right angle or worm gear drive to the upper end of the tubular member.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIG. 3 is a section taken along line 3—3 of FIG. 2;

FIG. 6 is a schematic view of the hydraulic lines and controls used in accordance with the present invention.

DETAILED DESCRIPTION OF A PREFERRED EMBODIMENT

Figure 1:
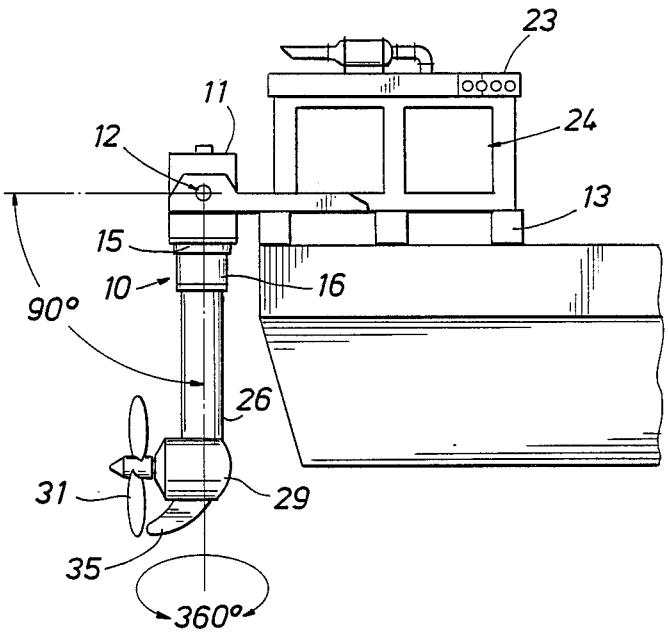
FIG. 1 is a schematic side elevation of a marine propulsion unit in accordance with this invention mounted on the stern of a barge.

Referring initially to FIG. 1, a retractable, compass-type thruster assembly 10 that is constructed in accordance with the concepts of the present invention is shown as including an upper tubular housing 11 that is mounted by diametrically opposed trunnions 12 to the outer end of a base or skid 13. The base 13 can be generally rectangular in overall configuration, and is adapted to be mounted on the deck of a vessel, such as a barge, at the stern as shown. The base 13 mounts a suitable drive motor, such as a diesel engine 24, having a hydraulic pump that is driven by its output shaft. Suitable instrumentation and controls 23 are located at a convenient station on the base so that an operator can steer the vessel and control the drive to the motor, as will be set forth in greater detail below.

Figure 2:
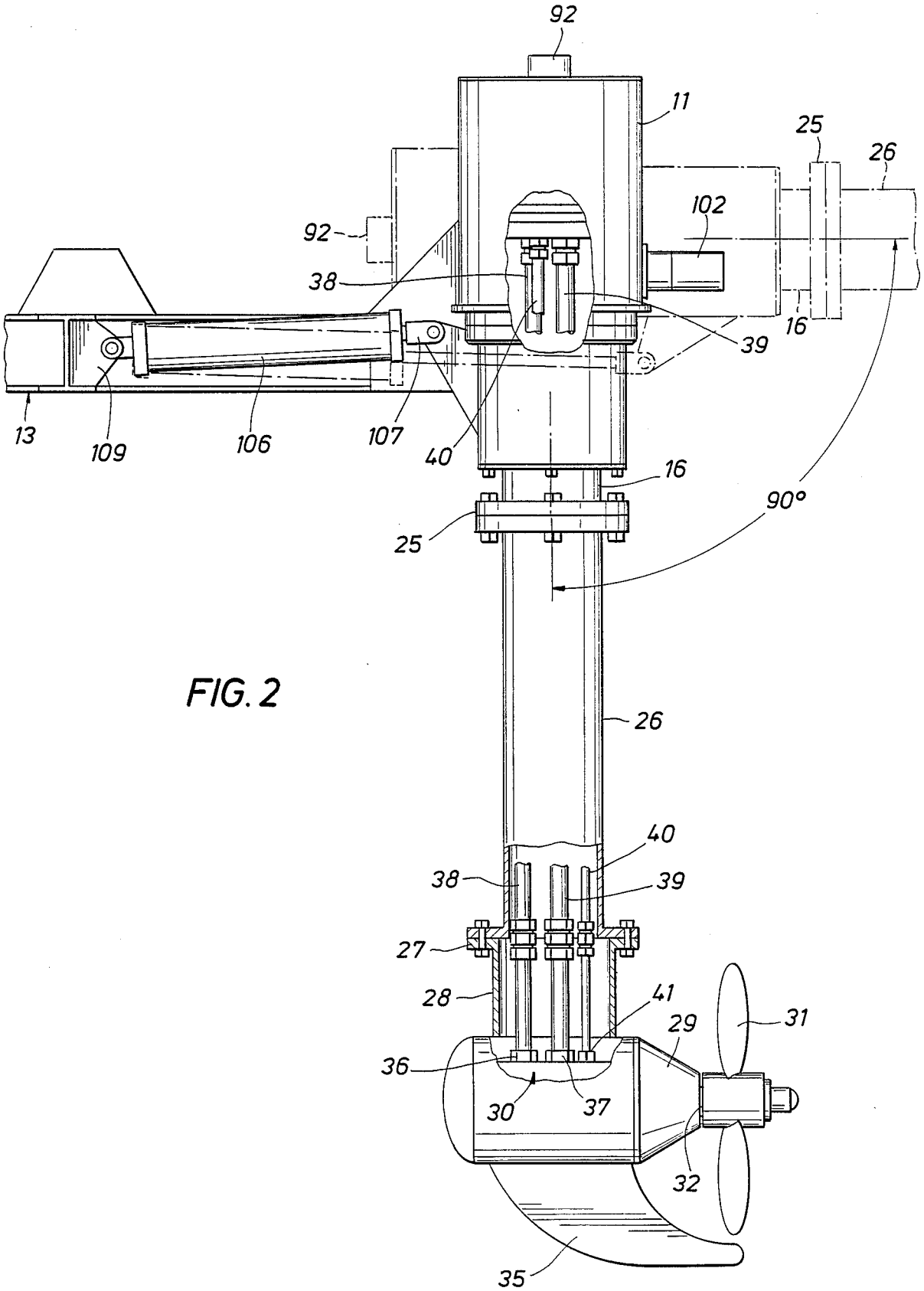
FIG. 2 is a longitudinal elevational view, with some portions in section, of a retractable marine thruster apparatus in accordance with the present invention.
Figure 4:
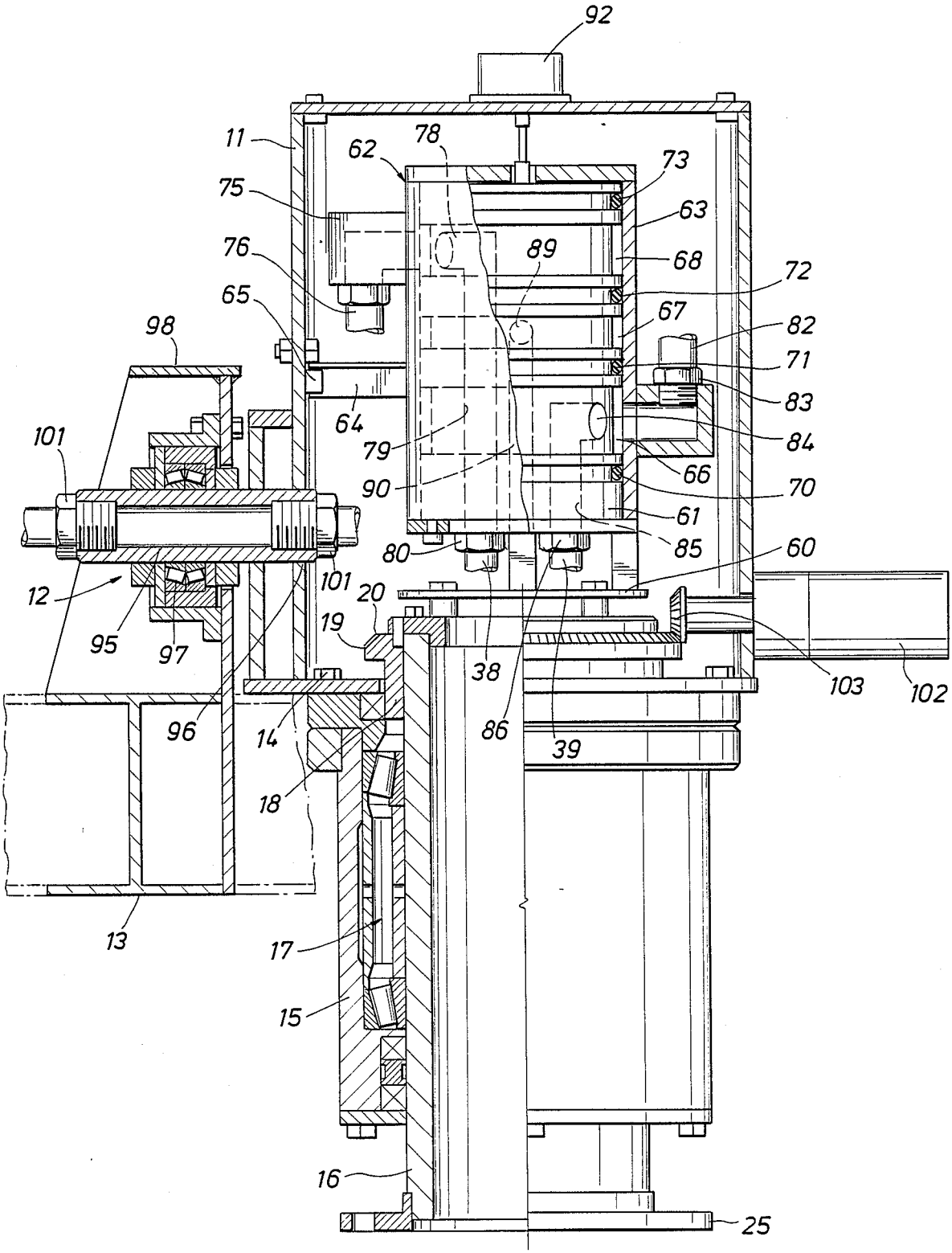
FIG. 4 is a longitudinal sectional view, with portions in side elevation, of the upper components of the thruster.

As shown in FIGS. 2 and 4, the housing 11 is secured by bolts 14 to an annular head 15 that has a swivel tube 16 extending upwardly therein. The tube 16 is mounted by a bearing assembly 17 in a manner to be rotatable with respect to the head 15 through a full 360°. A flange 18 at the upper end of the tube 16 carries a ring 19 having gear teeth 20 that are engaged by bevel gear 103 as will be explained further, whereby the ring and tube can be rotated about the vertical in either direction to provide steering of the thruster 10.

The lower end of the swivel tube 16 is flanged at 25 to the upper end of an extension tube 26 that has its lower end flanged at 27 to the upper section 28 of a propeller hub or housing 29. A hydraulic drive motor indicated generally at 30, which preferably is a cross-vane, fixed displacement, reversible design made by the Rineer Company, San Antonio, Tex., is mounted in the hub 29, and a propeller 31 is mounted directly onto the output shaft 32 of the motor 30. In a typical manner, a blade 35 can be secured to the bottom side of the hub 29 to provide a protection for the propeller 31.

The motor 30 is provided with input-output connections 36, 37 to which flexible, high pressure hoses 38, 39 are secured. A third, smaller diameter line 40 is connected at 41 to an internal passage in the hub 29 that leads to the bearing assembly for the propeller shaft 32, and through which a supply of oil can be fed under positive pressure to lubricate the bearing and prevent the entry of water and/or silt into the interior of the hub.

Figure 5:
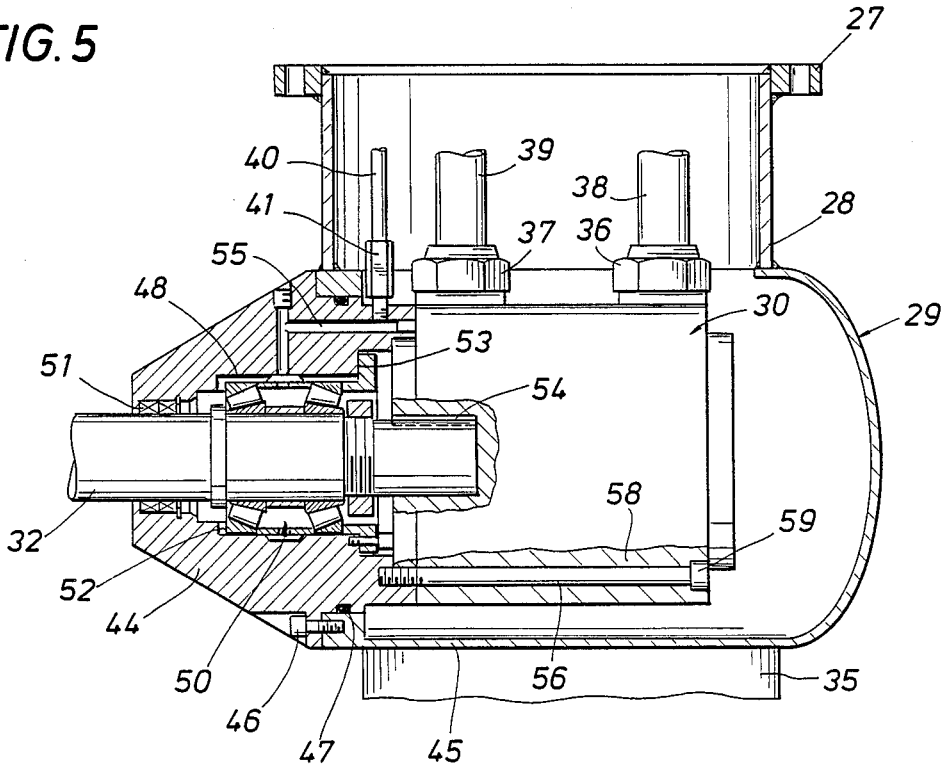
FIG. 5 is a side sectional view of the hub assembly.

Further structural details of the hub 29 and the hydraulic motor drive assembly are shown in FIG. 5. The hub 29 includes a bearing section 44 that is secured to a hollow housing member 45 by bolts 46 and a suitable seal ring 47. The section 44 has an axial bore 48 through which the output shaft 32 of the drive motor 30 extends, and within which is mounted the bearing assembly 50. Seals 51 engage the outer diameter of the shaft 32 to prevent fluid leakage. The bearing assembly 50 is held against an internal shoulder 52 by a retainer ring 53. The inner end of the shaft 32 is provided with splines 54, or the like, that couple the shaft to the rotor of the hydraulic motor 30. As previously mentioned, a lubricating oil passage 55 extends from the connection 41 to the region of the bearing assembly 50.

The housing 58 of the hydraulic motor 30 is secured to the rear wall of the bearing section 44 by elongated bolts 59 that extend through annularly distributed holes 56 in the motor case 58. In order to drive the motor 30 in one rotational direction, hydraulic oil under pressure is fed to one connection 36, with return of oil being via the other connection 37. The motor 30, and thus the rotational direction of the propeller 31, is reversed by providing hydraulic oil under pressure to the opposite connection 37, with oil return being via the other connection 36. As previously mentioned, the motor 30 is a cross-vane, positive displacement device having high efficiency, whereby a flow of hydraulic oil therethrough will cause the shaft 32 and the propeller 31 to rotate in one direction or the other.

Referring now to FIGS. 3 and 4 for a more detailed description of the upper components of the thruster assembly 10, a ring 60 that is bolted or otherwise secured to the upper end of the swivel tube 16 has the inner member 61 of hydraulic swivel assembly 62 attached thereto in a suitable manner. The member 61 extends upwardly into an outer member 63 that is fixed against rotation within the housing 11 by one or more arms 64 and clamps 65. The inner member 61 has a plurality of vertically spaced, external annular recesses 66, 67, 68, and carries seal rings 70–73 on opposite sides of the recesses which engage internal wall surfaces of the outer member 63 to prevent fluid communication between, and to seal off, the annular recesses 66–68. The upper recess 68 is communicated by a connector block 75 to an oil input line 76, and by a passage having a radial portion 78 and a vertical portion 79 to a lower connector 80 to which the upper end of the flexible oil line 38 is attached. In a similar manner, the lower recess 66 is communicated with a hydraulic oil supply hose 82 by a connector block 83, and with the upper end of the flexible line 39 by passages 84, 85 and a lower connector 86. The intermediate recess 67 communicates with another connector block and lubricating oil supply hose (not shown), and with the smaller flexible line 40 via passages 89, 90. Thus arranged, the inner member 61 can rotate or swivel freely within the outer member 63 as hydraulic oil under pressure is circulated to and from the motor 30, and as lubricating oil is supplied to the propeller shaft bearing 50.

A thrust direction indicator shaft 92 can be mounted on the upper end of the inner member 61, and have a radial arm or the like (not shown) at its upper end that engages a resistance element through which electric current is fed so as to provide an output voltage to a remote indicator that is indicative of thrust direction with respect to a reference line.

The hydraulic oil hoses 76 and 82 can be relatively short, flexible sections that are communicated to the outside of the housing 11 by connections arranged along the axial centerlines of the trunnions 12. As shown in FIG. 4, each trunnion 12 includes a hollow pin 95 having its inner end secured to the housing 11 at 96, and which extends through a bearing 97 mounted to the base 13 at 98. Inner and outer hose connections 100 and 101 are provided for connection, respectively, to a short hose 76 or 82, and to the outer end of lines or pipes that lead toward the pump.

As shown in FIG. 4, steering of the thruster 10 can be accomplished through selective operation of a hydraulic motor 102 having a bevel output gear 103 that meshes with the teeth 20 on the ring gear 19. Alternatively the steering motor 102 can be mounted by a suitable bracket within the housing 11 in a horizontal position, and have an output worm gear in engagement with the ring gear 19. As shown, the motor 102 is mounted with its output shaft on a line that is radial to the axial centerline of the swivel tube 16. The motor 102 has hydraulic line connections that lead toward an auxiliary pump on the base 13, as will be described in further detail below.

The thruster 10 can be pivoted through an angle of about 90° in order to raise the hub 29 and the propeller 31 out of the water through selective extension of a hydraulic cylinder 106 shown in FIG. 2. The cylinder 106 has its rod end 107 pivotally attached to a bracket 108 on the housing 15. The rod pin is located somewhat below the axial centerlines of the trunnion pins 95 to provide a suitable moment arm. The rear end of the cylinder 106 is pivotally attached to another bracket 109 on the skid 13. As the cylinder 106 is extended by application of fluid pressure to the outer face of its piston, the lower end of the thruster 10 will be pivoted upward to the position shown in phantom lines in FIG. 2.

The hydraulic circuits, controls and other components of the present invention which are mounted on the base or skid 13 are shown diagramatically in FIG. 6. The pump 110, which is a conventional variable volume, axial piston pump, is driven directly by the output shaft of the diesel engine 111. A suction line 112 brings hydraulic oil from a head tank 113 via a ball-type shut-off valve 114 and a filter 115, and outlet lines 116, 117 lead to a cross-over relief valve 118. Lines 119, 120 go to the respective connectors 101 on the pins 95 of the trunnions 12 that pivotally mount the thruster unit 10 to the skid 13. By way of the flexible hoses and connections described above, hydraulic oil under pressure is supplied to the connections 38, 39 on the propeller drive motor 30. Oil under pressure also is supplied by the pump 110 via a line 125 to a directional control valve 126 that can be operated to actuate the retraction cylinder 106 when it is desired to raise the thruster unit 10 to the horizontal position. A line 127 from the valve 126 supplies oil under pressure via a valve 128 to a second directional control valve 129 which can be actuated to supply pressurized oil to a line 130 or a line 131 that leads to the steering motor 102, depending upon the direction in which the thruster is to be steered. Oil coming from the steering motor 102 is fed back to the tank 113 by a line 132 having a filter 133 therein. An oil supply under gravity head is sent to the propeller shaft bearing 50 by a line 135. Another suction line 136 having a valve 137 therein feeds oil to pump 110 also. Various other lines (not shown) lead to typical pressure gauges on the control panel 23 so that the operation can be continually aware of system pressures. The directional control valves 126 and 129 preferably are electrically operated devices that are controlled remotely from the panel 23. The cross-over relief valve 118 that controls the direction of rotation of the propeller 31 also is operated from the panel 23. If desired, an oil return line (not shown) from the pump 110 to the tank 113 can have a heat exchanger connected therein to cool the oil in the system.

OPERATION

In operation, the thruster 10, assembled as shown in the drawings, is pivotally mounted to the rear of the base 13, and the various hose connections are made between the lines leading from the pump 110. The entire assembly is positioned on the stern of a vessel such as a barge or small ship, and the base 13 is rigidly fastened to the deck by bolts or the like. The diesel engine 24 is started up and brought up to a constant speed at which it runs most efficiently. The engine 24 drives the pump 110 which is mounted directly on the engine flywheel housing. The pump 110, which, as previously mentioned, is an axial piston device with adjustable stroke and built-in charge pump, drives the variable speed hydraulic motor 30 which is directly connected to the propeller 31.

The thruster 10 can be operated from full speed down to a few rpms in either forward or reverse. Response time is extremely short due the relatively small moments of propeller and drive shaft inertia. This characteristic makes the thruster unit 10 much more maneuverable and powerful so that operator can readily cope with either ordinary or emergency situations.

The pump 110 has auxiliary outputs that are used to power the steering motor 102 and the retraction cylinder 106. Since the engine 111 always runs at a constant speed, with propeller speed being controlled by adjustment of the pump stroke, steering speed is always constant. Due to the absence of reversing and right angle gear transmissions, the unit 10 operates very quietly compared to prior devices.

The operator controls propeller speed from the control panel 23 by way of a "joy-stick" type control. In the neutral position, the pump 110 does not deliver any flow to the lines 116, 117. The stick is moved one way or the other in order to adjust the pump stroke to provide accurate pump output control from zero to full flow in forward or reverse.

Steering is accomplished by remote actuation of the valve 129 to supply oil under pressure to either the line 130 or the line 131. When the valve 129 is in neutral, the thruster unit 10 will maintain its direction. Oil exhausted from the steering motor 102 will be returned to the tank 113 via line 132. The hydraulic swivel assembly 62 allows for a full 360° of rotation of the hub 29.

In order to retract the unit 10 to the horizontal for maintenance or repair, the valve 126 is actuated to supply oil under pressure to the line 140. As the cylinder 106 extends, the lower portion of the thruster is forced to pivot outwardly until it reaches the horizontal position.

Since drive of the present invention is entirely hydraulic, proper operation does not depend on accurate alignment of internal drive components such as shafts and right angle gears. In the case of accidental grounding, excessive bending loads will not result in seizure of parts or any permanent damage to the thruster. Since rotating inertia is confined to the propeller, shaft and motor rotor, should the propeller hit an object, no substantial damage should occur. The valve 118 has a relief feature that exhausts pressure from the high pressure side to the low pressure side, thereby minimizing the likelihood of damage to the propeller 31.

The hydraulic outboard drive unit of the present invention requires very little maintenance, such as checking for hose leaks and proper of fluid levels. Thus no highly skilled services are required, and any repairs can be made in the field with parts that are readily available.

It now will be recognized that a new and improved outboard marine thruster unit has been disclosed. Since certain changes or modifications may be made in the disclosed embodiment without departing from the inventive concepts involved, it is the aim of the appended claims to cover all such changes and modifications falling within the true spirit and scope of the present invention.

What is claimed is:

1. A compass-type outboard marine thruster apparatus, comprising: a horizontally disposed base adapted to be rigidly mounted to the deck of a marine vessel; a housing; spaced-apart trunnions on opposite sides of said housing for mounting said housing on said base for pivotal movement about a horizontal pivot axis and for suspending said housing rearwardly of the stern of said vessel; a bearing head connected to the lower end of said housing; an elongated tubular structure having an upper section that extends upwardly within and through said head, the longitudinal axis of said tubular structure being in the same plane with and at a right angle to said horizontal pivot axis; bearing means for mounting said tubular structure for rotation with respect to said head and said housing; propeller hub means fixed to the lower end of said tubular structure; hydraulic motor means mounted in said hub means and having an output shaft; propeller means coupled to said output shaft; and hydraulic lines extending from said motor means up through said tubular structure and into said housing to a location above the upper end of said upper section for conveying hydraulic fluid under pressure to and from said motor means.

2. The apparatus of claim 1 further including hydraulic swivel means mounted in said housing, said swivel means comprising an inner member fixed to the upper end of said upper section, an outer member fixed to said housing and within which said inner member is rotatable, hydraulic connector means on said outer member, and hydraulic fluid passage means in said inner member for fluidly connecting said connector means to said hydraulic lines.

3. The apparatus of claim 2 wherein each of said hydraulic fluid passage means includes an external annular recess on said inner member, a transverse port opening into said recess means, and a longitudinal passage for communicating said port with the upper end of a respective one of said hydraulic lines.

4. A compass-type outboard marine thruster apparatus, comprising: a housing; mounting means for pivotally mounting said housing on a base about a pivot axis; a bearing head connected to the lower end of said housing; a tubular structure having an upper section that extends upwardly within and through said head, said tubular structure being rotatable with respect to said head and said housing; propeller hub means fixed to the lower end of said tubular structure; hydraulic motor means mounted in said hub means and having an output shaft; propeller means coupled to said output shaft; hydraulic lines extending from said motor means up through said tubular structure and into said housing to a location above the upper end of said upper section for conveying hydraulic fluid under pressure to and from said motor means; hydraulic swivel means mounted in said housing, said swivel means comprising an inner member fixed to the upper end of said upper section, an outer member fixed to said housing and within which said inner member is rotatable, hydraulic connector means on said outer member, hydraulic fluid passage means in said inner member for fluidly connecting said connector means to said hydraulic lines, each of said hydraulic fluid passage means including an external annular recess on said inner member, a transverse port opening into said recess, and a longitudinal passage for communicating said port with the upper end of a respective one of said hydraulic lines; and conduit means for conveying hydraulic oil through said mounting means along said pivot axis for delivery to said connector means on said outer member.

5. The apparatus of claim 4 further including flexible hose means extending between said conduit means and said connector means.

6. The apparatus of claim 4 further including bearing means for mounting said shaft on said hub means, and separate hydraulic line means extending downward through said tubular structure for delivering a lubricant to said bearing means.

7. The apparatus of claim 4 further including selectively operable means for rotating said tubular structure with respect to said head and said housing to effect steering of said thruster apparatus.

8. The apparatus of claim 7 where said selectively operable means includes a hydraulic motor having a gear on its output shaft, and gear means on the upper end of said tubular structure, said gears being in mesh with one another.

* * * * *